US005232202A

United States Patent [19]

Watson

[11] Patent Number: 5,232,202

[45] Date of Patent: Aug. 3, 1993

[54] TANK LIFTING METHODS

[76] Inventor: Alan R. Watson, P.O. Box 22641, Otahuhu, New Zealand

[21] Appl. No.: 758,687

[22] Filed: Sep. 12, 1991

[51] Int. Cl.[5] ..... B66F 1/08

[52] U.S. Cl. ..... 254/1; 254/89 H; 254/93 HP

[58] Field of Search ..... 254/1, 89 H, 89 R, 93 HP, 254/93 R, 105, 108–111

[56] References Cited

U.S. PATENT DOCUMENTS

| | | | |
|---|---|---|---|
| 2,714,011 | 7/1955 | Albee | 280/1 |
| 2,749,592 | 6/1956 | Vartia | 25/155 |
| 3,010,698 | 11/1961 | Allen | 254/2 |
| 3,063,675 | 11/1962 | Allen | 254/2 |
| 4,060,170 | 11/1977 | Walters | 254/93 HP |
| 4,061,310 | 12/1977 | Vetter | 254/93 |
| 4,518,151 | 5/1985 | Dill, Jr. | 254/93 HP |
| 4,807,851 | 2/1989 | DeCastro | 254/1 |
| 4,930,750 | 6/1990 | DeCastro | 254/89 H |

FOREIGN PATENT DOCUMENTS

| | | | |
|---|---|---|---|
| 1477672 | 5/1989 | U.S.S.R. | 254/93 HP |

*Primary Examiner*—Bruce M. Kisliuk
*Assistant Examiner*—E. Morgan
*Attorney, Agent, or Firm*—Hubbard, Thurman, Tucker & Harris

[57] ABSTRACT

A method of lifting storage tanks by using pressurized bags and support members. Lifting the tank allows for visual inspection under the tank for corrosion to prevent leakage of environmentally hazardous chemicals stored in the tank. The lifting bags are placed under the tank, inflated, and support timbers placed under the raised tank. The bags are then deflated allowing the tank to rest on the support timbers. The deflated bags are raised by placing support timbers under the bags. The bags are again pressurized further raising the tank. The steps are repeated until the tank is lifted to the desired height. Ground suction is broken by raising one side of the tank with the lifting bags, placing supports as far as possible under the tank rim and depressurizing the bags to rock the other side of the tank off the ground. A fulcrum method is also applied to use the partial weight of the tank as a leverage force to alternately raise opposite sides of the tank.

14 Claims, 3 Drawing Sheets

FIG. 3
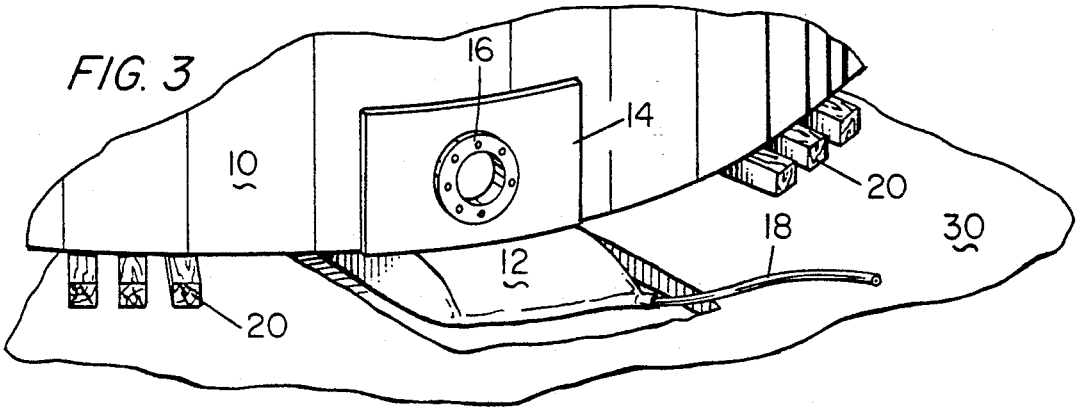
FIG. 4
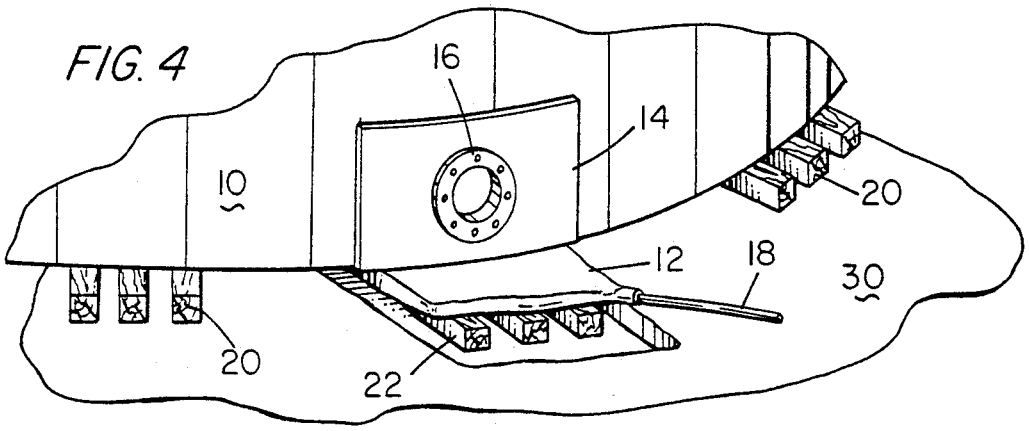
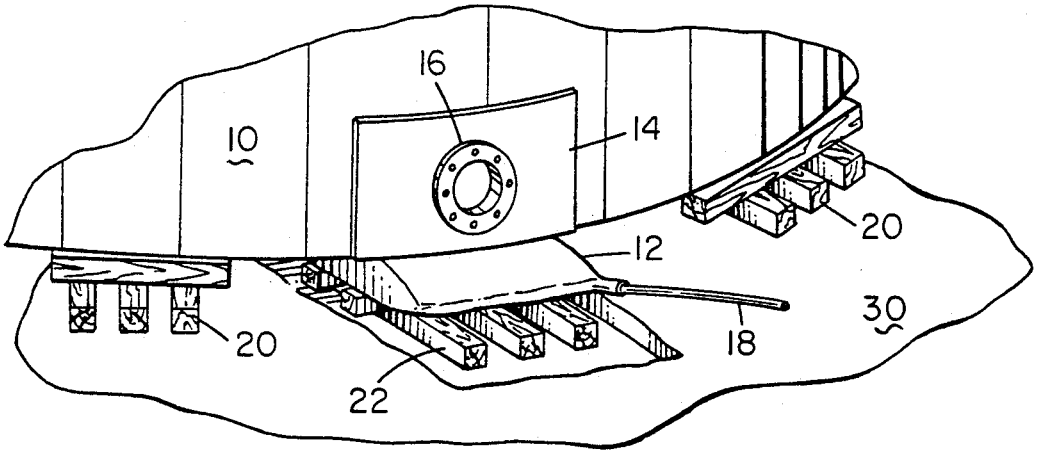
FIG. 5

TANK LIFTING METHODS

BACKGROUND OF THE INVENTION

The present invention relates to a method for lifting large storage tanks off the ground by using pressurized bags.

Large storage tanks holding environmentally hazardous products require inspection and maintenance to prevent the products from leaking and contaminating the surrounding soil and ground water supplies. Contamination and pollution of soil and water in the area of the tank can cause the owner enormous cleanup expense. Also, the tank can settle into the ground causing water to form pools around the tank increasing the possibility of corrosion.

Inspection and maintenance of the tank requires temporarily draining the tank. It is important that maintenance be done quickly to minimize the loss of valuable storage space. Inspection of the tank floor from inside the tank is highly inaccurate and cannot detect a faulty foundation or corrosion under the tank.

The preferred prior art method to prevent or correct leakage from the tank is to lift the tank so as to inspect and repair the tank floor from underneath the tank. After the tank is lifted, the bottom of the tank floor can be inspected, sand blasted, repainted, and cathodic protection installed. While the tank is lifted, foundation problems can be rectified and the general condition of the foundation can be upgraded. The foundation can be raised to compensate for any settling that has occurred over time. Improvements such as an impervious layer, leakage detectors, and drainage systems can be installed on the tank foundation while the tank is lifted.

Prior methods for tank lifting have required "hot" work, such as welding and torch cutting on the tank to provide attachment points to the tank for the use of hydraulic lifts. This hot work requires degassing the tank to prevent explosions. In a crowded tank farm, the danger of explosion is always present or difficult to control. Moreover, if the tank to be lifted is very large, holes must be cut in the floor of the tank so that the hydraulic lifts can be placed under the center of the tank floor. Thus, there is a need for providing a procedure of lifting storage tanks without encountering the considerable disadvantages of the prior art methods.

BRIEF SUMMARY OF THE INVENTION

The present invention uses pressurized bags to lift the tank. The method is safe, economical, and efficient using only pressurized bags and timbers. No hot work is required so there is no fear of explosion. The bottom of the tank can be fully inspected once the tank has been lifted. Improvements such as sand blasting and painting the bottom of the tank floor and upgrading the foundation can be performed without requiring the tank be degassed. Only if the tank is severely corroded or leaking will hot work be performed requiring precautions against explosion.

In the present method, the tank is lifted a small distance by inflating bags placed under the tank. Then support timbers are placed under the tank and the bags deflated. The bags are then placed on new supports and inflated to raise the tank higher. Since the bags can raise the tank only a few inches in each lift, the lift and support steps are repeated until the tank is lifted to the required working height.

If a large tank is being lifted, structural requirement may necessitate lifting the floor also. Since the deflated bags are only about two inches thick, the relatively thin unpressurized bags can be slipped under the tank's floor to lift the tank floor as the tank is being lifted thereby eliminating the need to cut holes in the floor.

BRIEF DESCRIPTION OF THE DRAWINGS

FIG. 3 is a perspective view showing the pressurized air bag of FIG. 2 lifting the tank off the ground with tank support members adjacent the bag;

FIG. 4 is a side view showing the unpressurized air bags raised on support members ready to begin another lift cycle;

FIG. 5 is a side view showing the pressurized air bags having further lifted the tank;

DESCRIPTION OF THE PREFERRED EMBODIMENT

Figure 1A:
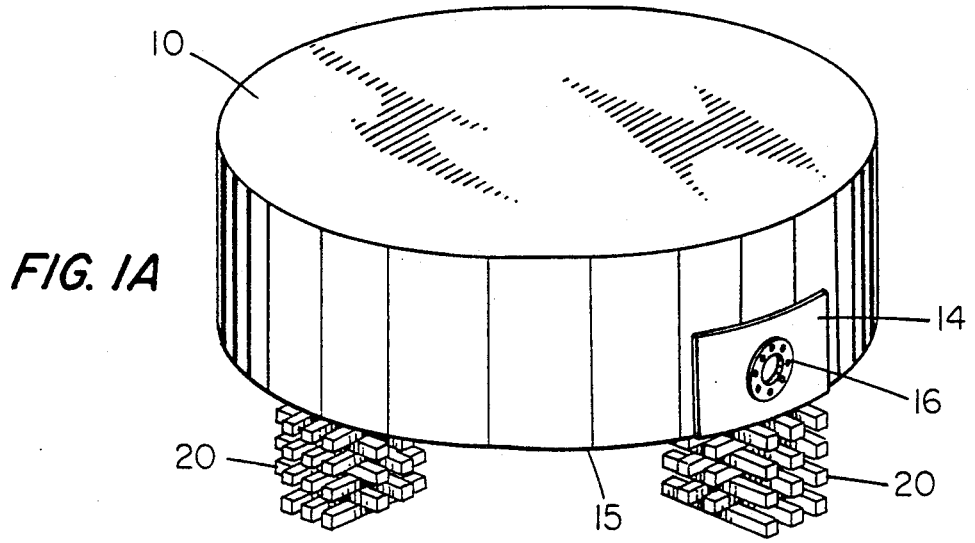
FIG. 1A is a perspective view of a tank lifted by the method of the present invention and sitting on support members.
Figure 1B:
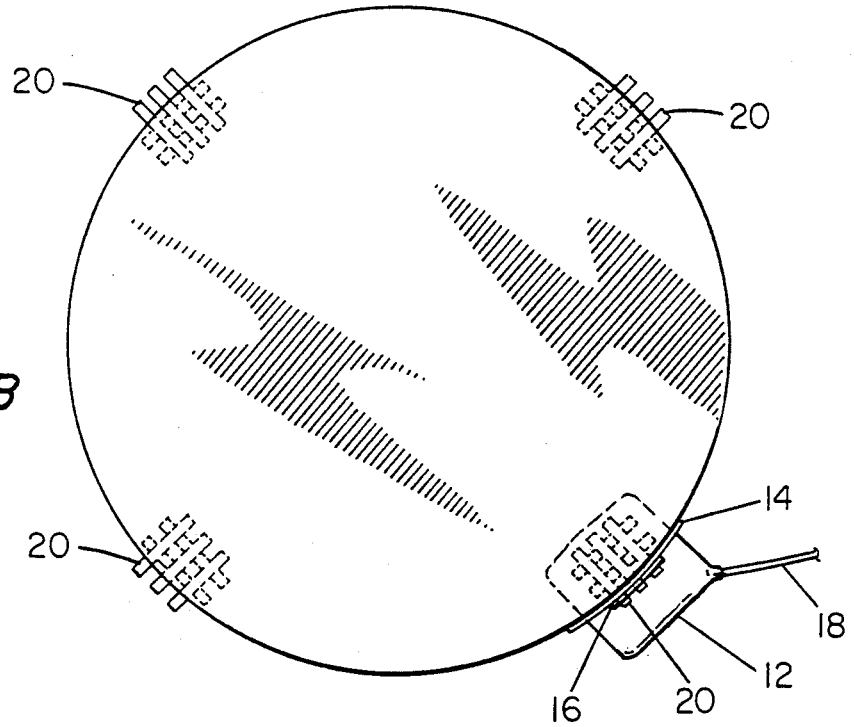
FIG. 1B is a top view of the tank of FIG. 1A.

The object of the present invention is to lift a large storage tank 10 to a level shown in FIG. 1A, preferably 8–10 feet off the ground, so that work may be done on the underside of the tank floor and on the ground beneath the tank. Preferably the tank is supported by tank support members 20 consisting of several layers of a plurality of hardwood timbers, each layer being stacked crosswise with the immediate adjacent layers, as shown. Referring to FIG. 1B, the support members 20 are spaced around the periphery of the tank base 15 so as to maintain the tank in a stable, even position. Sufficient support members 20 are used so that selected members may be temporarily removed to enable the entire foundation to be worked on as needed.

Before a storage tank 10 can be lifted, the structural design and condition of the tank must be analyzed to determine the number and placement of lifting bags 12 and tank support members 20 to ensure the tank will be lifted safely and without damage. The analysis includes a determination of the size, weight and shape of the tank, the thickness of its walls, the type of material used, and the age and structural condition of the tank. Other factors to consider include wind loading, earthquake loading and bulk storage loading on the foundation.

Figure 2:
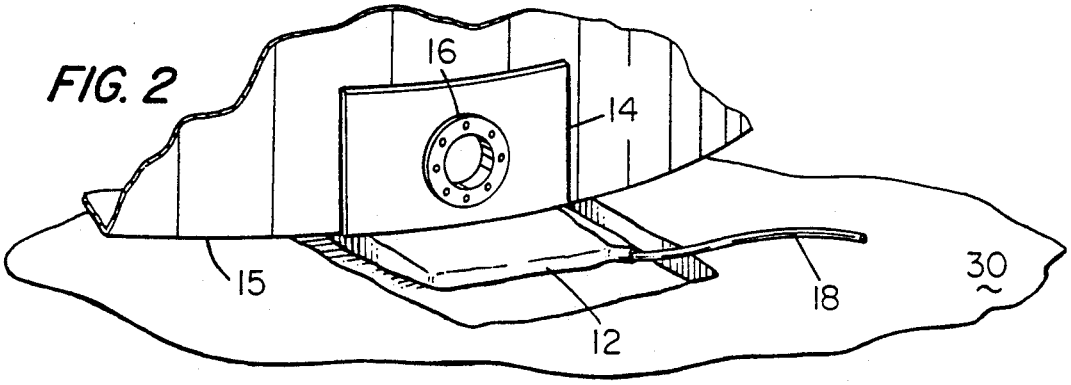
FIG. 2 is a perspective view showing an unpressurized air bag under the edge of the tank of FIG. 1A according to the process of the present invention.

Referring now to FIG. 2, the beginning of the process of the present invention to lift a storage tank is shown. Initially, it is usually necessary to break the suction between the bottom of the tank and the foundation. Therefore, the first lifting bags 12 are preferably placed under the tank 10 at or near the compensating plate 14 or service hole 16, where the tank wall is usually thickest and strongest. The lifting bags 12 are conventional rubber bags manufactured from reinforced interwoven layers of synthetic materials. They preferably are three feet by three feet square by one and one-half inches thick and have a safe working pressure of 120 pounds per square inch (psi). One preferred source for the bags is model V68 bags made by Manfred Vetter Gmbh in Zuelpich-Langendorf, Germany. It is also understood that other pressurized vessels may be used besides bags 12 which are suitable to provide hydraulic lifting according to the present invention.

The tank support members 20 are hardwood timbers and their size is determined by the height required to be lifted. The preferably size of the tank support members 20 is six inches by five inches by five feet long. The bag support members 22 are also of hardwood timber and their preferred size is six inches by five inches by three feet long. It is understood that other types of support members for the tank and the bags may be used as long as they are suitable to carry out the methods of the present invention.

The pressure required in the bag 12 to lift the tank 10 is controlled by using conventional valves and regulators. Any number of bags can be used at the same time to get complete control over the lifting so no undue stress is created on the tank. Preferably the bags are all filled from a central air supply. The lifting height is preferably controlled from 1/16 inch to twelve inches in any one lift. It is understood that bags 12 may also be filled with water or other fluid suitable to pressurize the bags.

As shown in FIG. 2, to place the lifting bags 12 under the tank 10, a hole three feet wide, extending eighteen inches under the tank and two inches deep into the ground 30, is dug out for each bag. Each bag 12 is then placed in a hole and connected to the control valves and regulators by air hoses 18. The bags 12 are slowly inflated with pressure while watching to see if the tank 10 is lifting away from the ground 30. If ground suction prevents the tank from lifting off the ground, the pressure is stopped at sixty psi and the pressure in the bags is allowed to pulsate to help break the suction. Should the suction not be broken at sixty psi, the pressure is increased by ten psi and the pulsating repeated until one hundred psi is reached. If the tank suction remains unbroken at one hundred psi, then more bags are inserted around the tank perimeter and the process repeated.

Referring now to FIG. 3, when the tank is six inches off the ground 30, tank support members 20 are inserted at calculated points on both sides of each of the bags 12 around the bottom periphery 15 of tank 10. The lifting bags 12 are then deflated by releasing the pressure to leave the tank 10 sitting on the tank support members 20.

As shown in FIG. 4, the bags 12 are removed from under the tank 10 and the bag support members 22 are placed in the same position as the bags. The bags 12 are placed on top of the bag support members 22 and inflated to one hundred psi which lifts the tank 10 another six to twelve inches. A second layer of tank support members 20 is placed cross-wise on top of the existing tank support members 20 as shown in FIG. 5. The bags 12 are then deflated and the tank 10 is supported on the new tank support timbers 20. This process is repeated until the tank 10 has been lifted to the required height off the ground 30, normally four to ten feet as shown in FIG. 1.

Figure 6A:
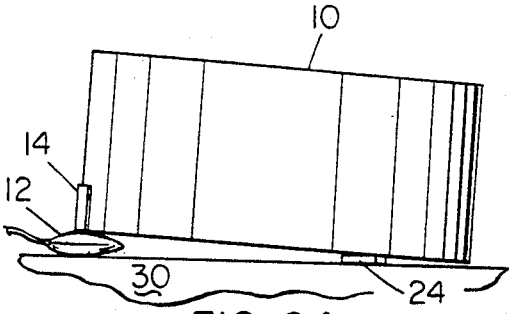
FIGS. 6A–6C are side, top and side views, respectively, showing the rocking method for breaking the suction under the tank in accordance with the present invention.
Figure 6B:
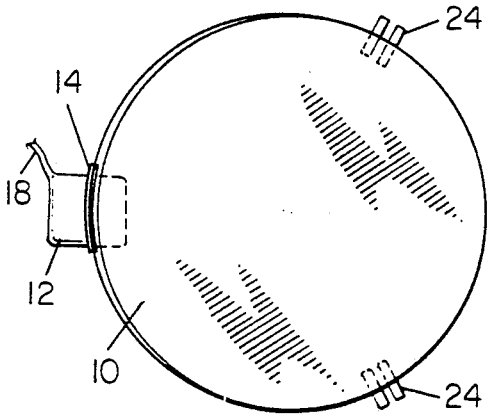
Figure 6C:
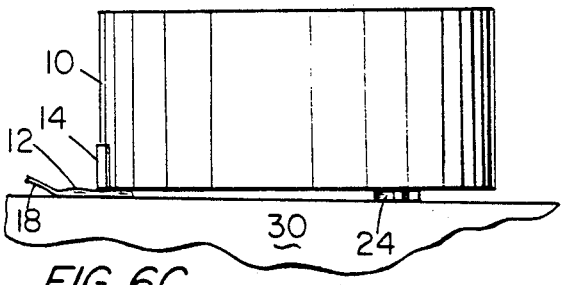

If the ground suction is severe, an alternative preferred rocking method can be used. This approach uses the weight of the tank 10 to break the remaining ground suction once one side has been lifted. Referring to FIGS. 6A and 6B, one or more bags 12 are placed under the adjacent side of the tank 10 below the compensating plate 14 as previously described and shown in FIG. 2. The bags 12 are pressurized until the adjacent side of the tank 10 is about six to eight inches off the ground 30. Then at least two rocking support members 24 are placed on the rim of the tank somewhat across from each other, each being about more than one-fourth of the tank circumference from the bags 12 where the tank 10 is only about two inches off the ground 30. One member 24 is placed in one direction more than one-fourth of the distance around the circumference from the bags and the other member 24 being placed the same distance in the other direction around the circumference from the bags. Preferably the supports are each placed about one-third of the circumference of the tank 10 from bags 12 on opposite sides, as best seen in FIG. **6*b*. Then bags 12 are depressurized and the weight of the tank 10 is used to lift the other side of the tank 10, thereby breaking any remaining ground suction that may exist under the tank 10, as shown in FIG. 6C**.

Figure 7A:
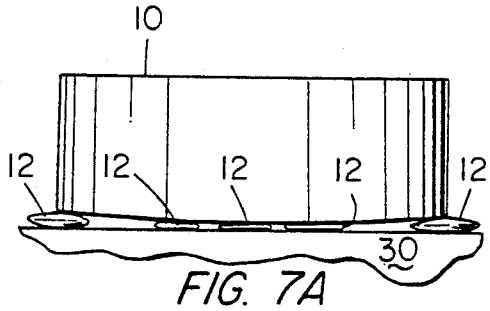
FIGS. 7A–7C show another process of the present invention providing air bags under of the center of the tank floor.
Figure 7B:
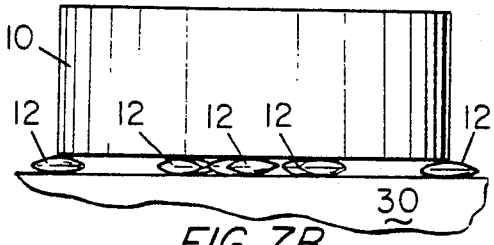
Figure 7C:
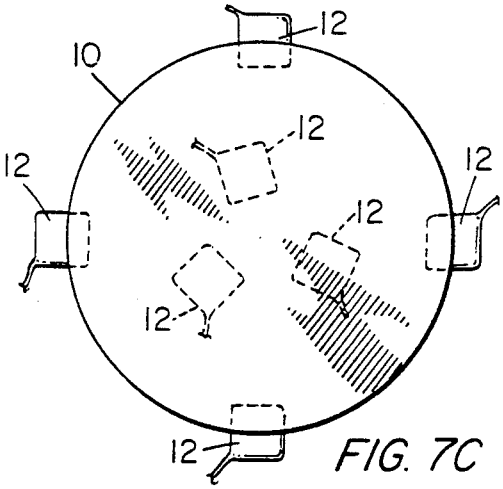

FIGS. 7A to 7C show an alternative procedure for lifting large tanks that need the tank floor 15 supported in the center. This has been a particular problem in the prior art, any many holes are often cut into the bottom of large diameter tanks to provide the required support, using prior art methods.

Using the methods of the present invention, there is no need to cut holes in the tank floor. As shown in FIGS. 7A–7C, additional bags 12 are strategically placed under the floor of the tank 10 as well as around the periphery. As the tank is raised, bag support members are placed to raise the bags so as to continue to support the tank floor. Preferably the tank is raised using only the bags around the periphery of the tank as described above, and the bags under the floor are used primarily for support of the tank floor. When the tank 10 has reached the required height at the perimeter based on design stress calculations, additional bags 12 may be placed under the tank floor 15 as required.

Figure 8:
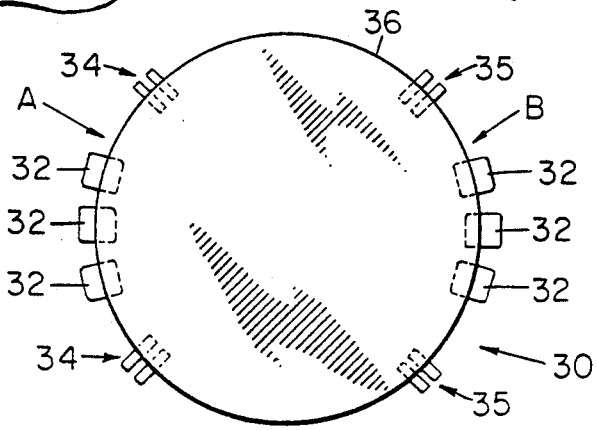
FIG. 8 is a top view of a storage tank showing the fulcrum method of the present invention for lifting the tank using fewer bags and support members.

Another preferred method of the present invention is the fulcrum method shown in FIG. 8. Using the fulcrum method, the tank 30 can be lifted to the required height using bags and timbers only at opposite ends of the tank. Thus, this procedure uses less bags and timbers than the previous described processes. One or more bags 32, which are identical to bags 12, are placed near each other under one side A of the tank 30. The bags 32 are then pressurized until side A of the tank is raised about eight inches. Two tank support members 34 are then placed on either side of the tank under the bottom rim 36 of the tank 30, less than one-fourth of the circumference from the bags 32. Then the bags 32 are depressurized and moved to the opposite side B of the tank 30. The opposite side B of the tank 30 is lifted and tank support members 35 are then placed under the opposite side B of the tank 30.

The bags 32 are then depressurized and moved back to side A on top of bag support members (not shown) such as member 22 shown in FIGS. 4 and 5. Preferably the bag support members are high enough so that as the bags 32 are pressurized they will raise tank side A above the tank support members 34. Members 34 are then increased in height to fit just under the tank 30 on side A. The bags 32 are then depressurized and placed under bag support members on side B similar to support member 22. Side B of the tank is lifted by pressurizing bags 32, building up tank supports 35 and depressurizing bags 32. The process is repeated moving the lifting bags to alternate sides of the tank until the tank has been raised to the desired height.

This fulcrum method enables lifting of the tank 30 using a part of the tank's weight as leverage. For example, by lifting tank 30 at side B after support members 34 are in place the lever arm length is shortened to the distance from the bags on side B to members 34 not to side A. Thus, the weight of the part of tank 30 between side A and members 34 provides leverage to help bags 32 lift tank 30 on side B. Bags 32 are then placed back at side A, on top of bag supports to raise the tank further. Leverage to assist this action is provided by the weight from the portion of the tank between supports 35 and side B.

Once the prescribed maintenance has been completed, the tank is lowered by reversing the above described processes.

Although the foregoing discloses preferred embodiments of the present invention, it is understood that those skilled in the art may make various changes to the preferred embodiments shown without departing from the scope of the invention.

What is claimed is:

1. A method of lifting a tank which comprises the steps of:
(a) removing the ground underneath the tank below the rim of the tank;
(b) sliding at least one unpressurized bag under the tank rim, the unpressurized bag resting on the ground;
(c) lifting the side of the tank by pressurizing the bag to break ground suction under the side of the tank;
(d) placing a plurality of support members under the tank rim, each support member being more than one-fourth the distance around the tank circumference from the position of the bag; and
(e) lowering the side of the tank by depressurizing the bag allowing the tank to rock on the support members, thereby lifting the side of the tank opposite the bag and thereby breaking the remaining ground suction.

2. The method of claim 1, further comprising:
(f) sliding at least one unpressurized bag under the tank rim;
(g) lifting the tank off the ground by pressurizing the bag;
(h) placing additional support members under the tank;
(i) lowering the tank onto the additional support members by depressurizing the bag;
(j) raising the level of the bag;
(k) and repeating steps (f)–(j) until the tank has been lifted to desired level.

3. The method of claim 2 wherein the steps (c) and (g) of lifting the tank by pressurizing the bag comprises inflating the bag with air.

4. The method of claim 2 further comprising the steps of:
(1) lowering the tank to the ground by:
(1) pressurizing the bag to lift the tank off the support members;
(2) lowering the support members under the tank;
(3) depressurizing the bag allowing the tank to rest only on the support members;
(4) lowering the unpressurized bag by lowering or removing the support members under the unpressurized bag;
(5) repeating steps (1)–(4) until the tank is resting on the ground.

5. A method of lifting a tank which comprises the steps of:
(a) positioning a first unpressurized bag under a first side of the tank;
(b) pressurizing the first bag to lift the first side of the tank;
(c) placing first tank support members underneath the tank on the first side of the tank;
(d) depressurizing the first bag to lower the tank onto the first tank support members;
(e) positioning a second unpressurized bag under a second side of the tank;
(f) pressurizing the second bag to lift said second side of the tank;
(g) placing second tank support members underneath the tank on the second side of the tank;
(h) depressurizing the second bag to lower the second side of the bag onto the second tank support members.

6. The method of claim 5 wherein the first and second tank support members are placed under the tank on both sides of the first and second bags, respectively.

7. The method of claim 5 wherein the second side of the tank is opposite the first side of the tank.

8. The method of claim 5 wherein the first and second bags are the same bag.

9. The method of claim 5 and further comprising the steps of:
(i) repeating the steps of (a) to (h) until the tank is lifted to the desired height.

10. The method of claim 5 wherein the steps (a) to (h) are repeated by placing a first bag support member under the unpressurized first bag in repeating step (a) and by placing a second bag support member under the unpressurized second bag before repeating step (e).

11. The method of claim 10 wherein said first and second bag support members raise the unpressurized first and second bags, respectively, to a level about equal to the level of the first and second tank support members, respectively.

12. The method of claim 5 wherein the first tank support members are placed under the first side a substantial distance from the first bag but not more than one fourth of the circumference from the first bag to form a lever so that the weight of the first side of the tank will provide a leverage force to assist lifting the second side of the tank.

13. The method of claim 12 wherein the second tank support members are placed a substantial distance but not more than one-fourth of the distance from the second bag to form a lever so that the weight of the second side will provide a leverage force to assist lifting the first side of the tank.

14. A method of lifting a tank comprising the steps of:
(a) removing the ground underneath a rim of the tank at locations on opposite sides of the tank;
(b) positioning an unpressurized bag on the ground under the rim of the tank at one of said locations;
(c) lifting the tank by pressurizing the unpressurized bag;
(d) placing tank support members under the lifted tank rim after pressurization of the bag and lowering the tank onto the support members by depressurizing the bag after said support members are placed;

(e) repositioning the unpressurized bag on the ground under the rim of the tank at the other of said opposite locations and repeating steps (c)–(d);

(f) alternately raising the unpressurized bag by placing bag support members under the bag at one of said opposite side locations and alternately repeating the steps of lifting the rim of the tank by pressurizing the bag, placing tank support members under the rim of the tank and lowering the tank on the tank support members by depressurizing the bag; and (g) repeating step (f) until the tank is lifted one side at a time to the desired height in order to reduce the number of bags and tank and bag support members needed.

* * * * *